US008963782B2

(12) United States Patent
Ayala Vazquez et al.

(10) Patent No.: US 8,963,782 B2
(45) Date of Patent: Feb. 24, 2015

(54) CAVITY-BACKED ANTENNA FOR TABLET DEVICE

(75) Inventors: Enrique Ayala Vazquez, Watsonville, CA (US); Robert W. Schlub, Campbell, CA (US); Yi Jiang, Cupertino, CA (US); Rodney Andres Gomez Angulo, Sunnyvale, CA (US); Ruben Caballero, San Jose, CA (US); Qingxiang Li, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 298 days.

(21) Appl. No.: 12/553,944

(22) Filed: Sep. 3, 2009

(65) Prior Publication Data

US 2011/0050509 A1 Mar. 3, 2011

(51) Int. Cl.

| | |
|---|---|
| ***H01Q 1/24*** | (2006.01) |
| ***H01Q 1/22*** | (2006.01) |
| ***H01Q 1/38*** | (2006.01) |
| ***H01Q 1/42*** | (2006.01) |
| ***H01Q 13/18*** | (2006.01) |

(52) U.S. Cl.

CPC ..... *H01Q 1/2266* (2013.01); *H01Q 1/38* (2013.01); *H01Q 1/42* (2013.01); *H01Q 13/18* (2013.01)

USPC ..... 343/702

(58) Field of Classification Search

USPC ..... 343/702

See application file for complete search history.

(56) References Cited

U.S. PATENT DOCUMENTS 2,972,147 A * 2/1961 Wilkinson ..... 343/767
4,733,245 A 3/1988 Mussler
5,726,664 A * 3/1998 Park et al. ..... 343/705
5,850,612 A * 12/1998 Kulberg et al. ..... 455/575.7
6,081,729 A 6/2000 Bauerschmidt et al.
6,097,339 A * 8/2000 Filipovic et al. ..... 343/702
6,225,959 B1 5/2001 Gordon
6,339,400 B1 1/2002 Flint et al.
6,380,899 B1 4/2002 Madsen et al.
6,380,930 B1 4/2002 Van Ruymbeke (Continued)

FOREIGN PATENT DOCUMENTS

CN 1549391 11/2004
WO 2006118587 11/2006

OTHER PUBLICATIONS

"Antenna Theory: A Review," Constantine A. Balanis, Proceedings of the IEEE, vol. 80, No. 1, Jan. 1992.*

(Continued)

*Primary Examiner* — Graham Smith

(74) *Attorney, Agent, or Firm* — Treyz Law Group; G. Victor Treyz; Michael H. Lyons

(57) ABSTRACT

An electronic device may have a cavity antenna. The cavity antenna may have a logo-shaped dielectric window. An antenna resonating element for the cavity antenna may be formed from conductive traces on a printed circuit board. An antenna resonating element may be formed from the traces. The antenna resonating element may be mounted on an antenna support structure. A conductive cavity structure for the cavity antenna may have a planar lip that is mounted flush with an interior surface of a conductive housing wall. The cavity structure may have more than one depth. Shallower planar portions of the cavity structure may lie in a plane. The antenna resonating element may be located between the plane of the shallow cavity walls and an external surface of the conductive housing wall.

27 Claims, 14 Drawing Sheets

(56) References Cited

U.S. PATENT DOCUMENTS

| | | | | |
|---|---|---|---|---|
| 6,496,149 | B1 * | 12/2002 | Birnbaum et al. | 343/702 |
| 6,639,560 | B1 * | 10/2003 | Kadambi et al. | 343/700 MS |
| 6,672,879 | B2 | 1/2004 | Neidich et al. | |
| 6,686,886 | B2 | 2/2004 | Flint et al. | |
| 6,853,336 | B2 | 2/2005 | Asano et al. | |
| 6,894,650 | B2 | 5/2005 | Darden et al. | |
| 6,937,192 | B2 * | 8/2005 | Mendolia et al. | 343/700 MS |
| 6,950,069 | B2 | 9/2005 | Gaucher et al. | |
| 7,009,563 | B2 * | 3/2006 | Mori et al. | 343/700 MS |
| 7,167,134 | B2 * | 1/2007 | Minami et al. | 343/718 |
| 7,283,095 | B2 * | 10/2007 | Karanik et al. | 343/700 MS |
| 2001/0053677 | A1 | 12/2001 | Schiffer | |
| 2002/0014996 | A1 | 2/2002 | Keilen et al. | |
| 2002/0080565 | A1 | 6/2002 | Teshima | |
| 2003/0210205 | A1 * | 11/2003 | Cencich et al. | 343/895 |
| 2004/0227679 | A1 * | 11/2004 | Lu | 343/702 |
| 2006/0083401 | A1 * | 4/2006 | Go | 381/396 |
| 2006/0244663 | A1 | 11/2006 | Fleck et al. | |
| 2009/0067141 | A1 | 3/2009 | Dabov et al. | |
| 2009/0153407 | A1 | 6/2009 | Zhang et al. | |
| 2009/0153412 | A1 | 6/2009 | Chiang et al. | |

OTHER PUBLICATIONS

Vazquez et al., U.S. Appl. No. 12/238,384, filed Sep. 25, 2008.
Chiang et al., U.S. Appl. No. 12/401,599, filed Mar. 10, 2009.
Vazquez et al., U.S. Appl. No. 12/486,496, filed Jun. 17, 2009.
Chiang et al., U.S. Appl. No. 12/104,359, filed Mar. 16, 2008.
Guterman et al., U.S. Appl. No. 12/553,943, filed Sep. 3, 2009.
Chiang, U.S. Appl. No. 12/356,496, filed Jan. 20, 2009.
Bevelacqua et al., U.S. Appl. No. 12/750,661, filed Mar. 30, 2010.
Shiu et al., U.S. Appl. No. 12/750,660, filed Mar. 30, 2010.
Chiang et al., U.S. Appl. No. 12/500,570, filed Jul. 9, 2009.
Pance, Aleksander, et al. U.S. Appl. 12/861,640, filed Aug. 23, 2010.

* cited by examiner

CAVITY-BACKED ANTENNA FOR TABLET DEVICE

BACKGROUND

Electronic devices such as computers and communications devices are often provided with wireless communications capabilities. For example, electronic devices may use long-range wireless communications circuitry such as cellular telephone circuitry to communicate using cellular telephone bands at 850 MHz, 900 MHz, 1800 MHz, and 1900 MHz (e.g., the main Global System for Mobile Communications or GSM cellular telephone bands). Long-range wireless communications circuitry may also be used handle the 2100 MHz band and other bands. Electronic devices may use short-range wireless communications links to handle communications with nearby equipment. For example, electronic devices may communicate using the WiFi® (IEEE 802.11) bands at 2.4 GHz and 5 GHz (sometimes referred to as local area network bands) and the Bluetooth® band at 2.4 GHz.

It can be difficult to incorporate antennas successfully into an electronic device. Space for antennas is often limited within the confines of a device housing. Antenna operation can also be blocked by intervening metal structures. This can make it difficult to implement an antenna in an electronic device that contains conductive display structures, conductive housing walls, or other conductive structures that can potentially block radio-frequency signals.

It would therefore be desirable to be able to provide improved antennas for electronic devices.

SUMMARY

Electronic devices may be provided with conductive housing walls. Antennas in the devices may be used to handle radio-frequency signals for local area network communications and other wireless signals.

An antenna may be provided with a logo-shaped dielectric antenna window that allows the antenna to operate from within the confines of the conductive housing walls. The logo-shaped dielectric antenna window may include a layer of glass and other dielectric materials that are transparent to radio-frequency antenna signals. A metal cavity structure may have a lip that is attached to the inner surface of the conductive housing walls using conductive adhesive. The metal cavity structure may form an antenna cavity for the antenna.

An antenna resonating element may be formed on top of an antenna support structure in the metal cavity structure. The support structure may be formed from a dielectric such as plastic and may have hollowed-out portions to reduce dielectric loading on the antenna. The antenna resonating element may be formed from conductive traces on a flex circuit or other substrate. The flex circuit may be mounted so that part of the flex circuit is supported by the support structure and so that part of the flex circuit is connected to the metal cavity structure.

The antenna may be fed using a transmission line such as a coaxial cable transmission line. Solder connections may be made between the transmission line and portions of the metal cavity structure. A recessed portion of the dielectric support may help ensure sufficient space is provided for forming solder contacts to the metal cavity. The metal cavity structure may be provided with a plated coating of a solderable metal to facilitate solder connections.

The coaxial cable may be routed between the flex circuit that contains the antenna resonating element and the metal cavity. A backside contact may be used to electrically connect a ground conductor in the coaxial cable to antenna ground and may serve as an antenna ground feed terminal. A backside contact may also be used to serve as a positive antenna feed terminal. Vias may be used to interconnect the backside antenna contacts to antenna resonating element traces in another layer of the flex circuit. The metal cavity structure may have a recessed portion in its lip to accommodate the coaxial cable.

The metal cavity structure may have walls that are at different depths beneath the surface of the housing walls. The shallower portions of the cavity may provide more interior volume within the electronic device for mounting components. The deeper portions of the cavity may provide more separation between the conductive cavity walls and antenna resonating element structures, thereby enhancing antenna performance. The lip of the metal cavity structure may lie in the same plane as the conductive housing wall to which the metal cavity structure is mounted. The shallower portions of the cavity may lie in a common plane. The antenna support structure may maintain the flex circuit that contains the antenna resonating element traces in a plane that lies above plane of the shallower cavity walls and, if desired, above the plane of the cavity lip.

Further features of the invention, its nature and various advantages will be more apparent from the accompanying drawings and the following detailed description of the preferred embodiments.

DETAILED DESCRIPTION

Figure 1:
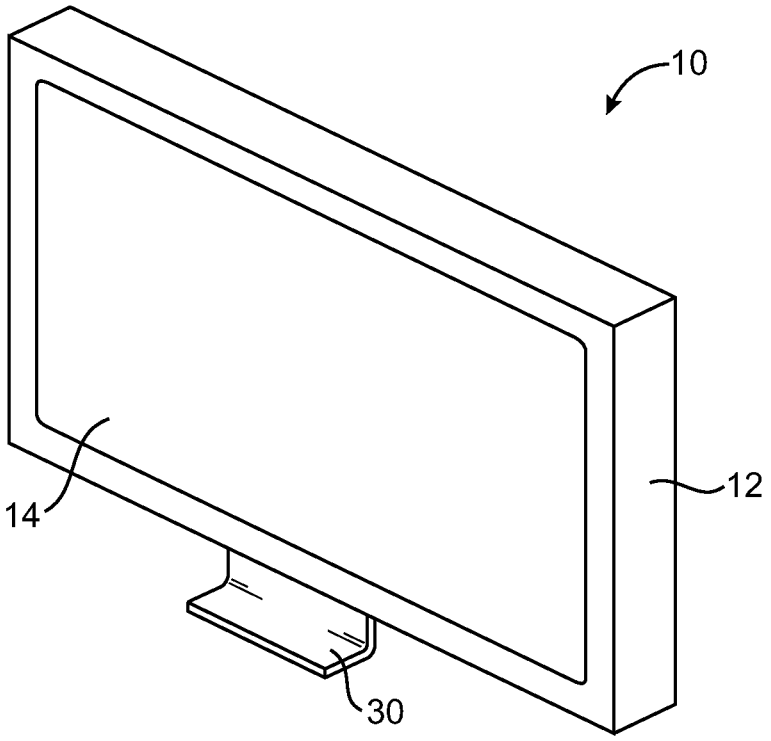
FIG. 1 is a front perspective view of an illustrative electronic device such as a computer with an antenna in accordance with an embodiment of the present invention.

Electronic devices may be provided with wireless communications circuitry. The wireless communications circuitry may be used to support wireless communications in one or more wireless communications bands. Antenna structures in an electronic device may be used in transmitting and receiving radio-frequency signals. The electronic device may have a conductive housing. For example, the electronic device may have a housing in which one or more portions are machined from blocks of aluminum or other metals. The metals may be coated with an insulating coating. For example, aluminum housing walls can be anodized. Other examples of conductive housing structures include conductive polymers, composites, and plastic structures with embedded conductive elements. Metal-filled polymers may exhibit conductivity due to the presence of conductive particles such as metal particles within the polymer material. Composite structures may include fibers such as carbon fibers that form a matrix. The matrix may be impregnated with a binder such as epoxy. The resulting composite structure may be used for an internal frame member or a housing wall and may exhibit non-negligible amounts of conductivity due to the electrical properties of the fibers and/or the binder. Plastic housing structures such as insert-molded structures may include embedded conductors such as patterned metal parts.

It can be difficult to successfully operate an antenna in an electronic device that is enclosed by conductive housing structures and conductive components such as displays. For example, conductive housing walls can block radio-frequency signals. It may therefore be desirable to provide a housing with a dielectric window structure.

To reduce visual clutter, it may be desirable to disguise or otherwise hide the antenna window. This can be accomplished by forming the window from a dielectric logo structure. With this type of arrangement, a dielectric logo may be mounted in a potentially prominent location on an electronic device housing. Because the logo carries branding information or other information that is of interest to the user of the electronic device, the logo may serve a useful and accepted information-conveying purpose and need not introduce an undesirable visible design element to the exterior of the electronic device. The dielectric materials that are used in forming the logo window or other dielectric antenna window structures may includes plastics (polymers), glasses, ceramics, wood, foam, fiber-based composites, etc. A dielectric antenna window may be formed from one of these materials or two or more of these materials. For example, a dielectric antenna window may be formed from a single piece of plastic, glass, or ceramic, or may be formed from a plastic structure that is coated with cosmetic layers of dielectric (e.g., additional plastics of different types, an outer glass layer, a ceramic layer, adhesive, etc.).

Antenna structures for the electronic device may be located under the logo or other dielectric window. This allows the antenna structures to operate without being blocked by conductive housing walls or conducting components. In configurations of this type in which the antenna structures are blocked from view but can still operate by transmitting and receiving radio-frequency signals through a logo-shaped dielectric, the antenna structures are sometimes referred to as forming logo antennas. Logo antennas may be used in environments in which other antenna mounting arrangements may be cumbersome, aesthetically unpleasing, or prone to interference due to the proximity of conductive housing walls or other conductive device structures that can block radio-frequency antenna signals.

Any suitable electronic devices may be provided with logo antennas. As an example, logo antennas may be formed in electronic devices such as desktop computers (with or without integrated monitors), portable computers such as laptop computers and tablet computers, handheld electronic devices such as cellular telephones, etc. In the illustrative configurations described herein, the logo antennas may sometimes be formed in the interior of a tablet computer or other computer with an integrated display. Arrangements such as these are, however, merely illustrative. Logo antennas and other antenna structures that use dielectric windows may be used in any suitable electronic device.

Logo antennas can be mounted on any suitable exposed portion of an electronic device. For example, logo antennas can be provided on the front surface of a device or on the rear surface of a device. Other configurations are also possible (e.g., with logos mounted in more confined locations, on device sidewalls, etc.). The use of logo antenna mounting locations on rear device surfaces and lower device surfaces may sometimes be described herein as examples, but, in general, any suitable logo antenna mounting location may be used in an electronic device if desired.

An illustrative electronic device such as a computer with an integrated display that may include a logo antenna is shown in FIG. 1. As shown in the illustrative front perspective view of FIG. 1, device 10 may be a computer having a housing such as housing 12. Display 14 may be mounted in housing 12. Housing 12 may be held in an upright position using stand 30.

Figure 2:
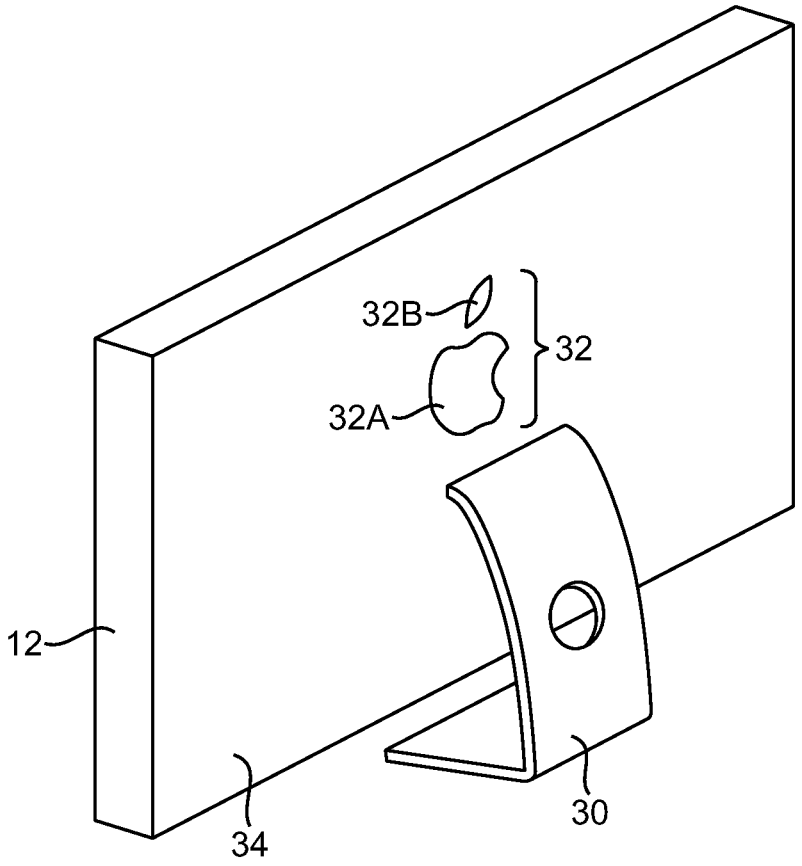
FIG. 2 is a rear perspective view of an illustrative electronic device such as a computer with an antenna in accordance with an embodiment of the present invention.

A rear perspective view of device 10 of FIG. 1 is shown in FIG. 2. As shown in FIG. 2, housing 12 may have a rear surface 34. Rear surface 34 may be substantially planar. For example, surface 34 may form a flat rectangular plane or may form a substantially planar surface that is slightly curved in one or two of its lateral dimensions. Housing 12 may be formed from structures that are conductive (e.g., metal, composites, metal-filed polymers, etc.). Device 10 may also contain displays, printed circuit boards, metal frames and other support structures, and other components that are conductive. To ensure proper operation of antenna structures that are mounted in the interior of housing 12 it may be desirable to provide housing 12 with an antenna window that is transparent to radio-frequency signals. During operation, signals can pass through the antenna window rather than being blocked by the conductive structures of device 10.

Dielectric antenna window structures such as logo-shaped antenna window structures 32 may be formed on rear housing surface 34 or other suitable portions of housing 12. All or part of structures 32 may serve as a dielectric window for an antenna that is mounted within housing 12. In the example of FIG. 2, structures 32 include structure 32A and structure 32B. Structure 32A is larger than structure 32B and may therefore be more suitable for use in forming an antenna window (as an example). In this type of configuration, structure 32B need not penetrate entirely through housing wall 34 and need not form an antenna window structure. The shape of structures 32 of FIG. 2 is merely illustrative. Any suitable shape may be used in forming dielectric antenna window structures if desired.

Figure 3:
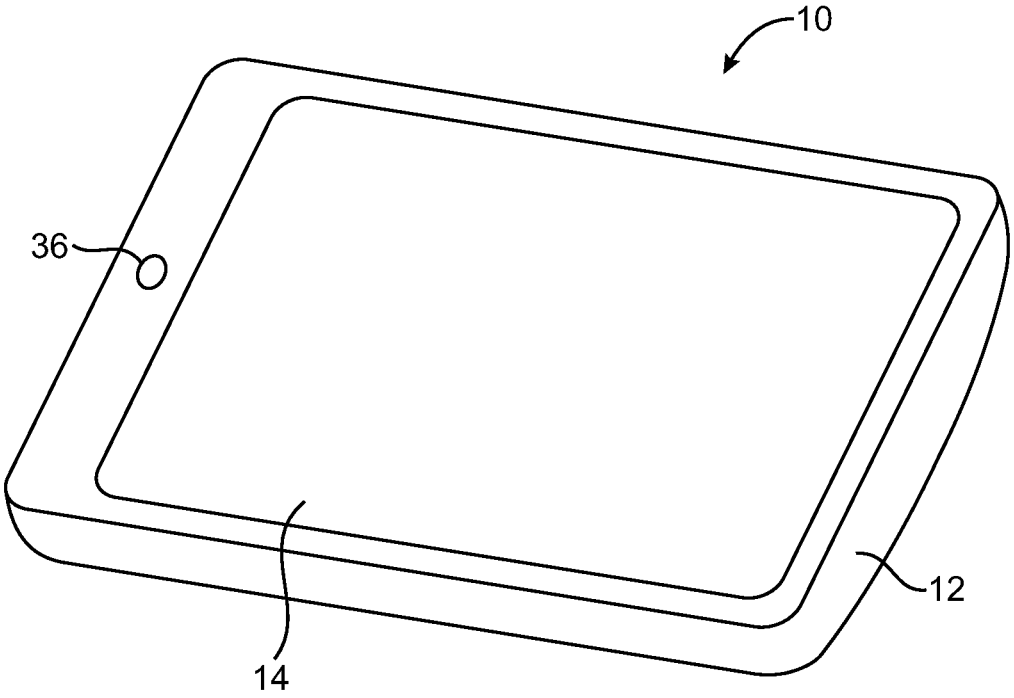
FIG. 3 is a front perspective view of an illustrative electronic device such as a tablet-shaped portable computing device with an antenna in accordance with an embodiment of the present invention.

An illustrative electronic device such as a tablet-shaped portable computer that may include a logo antenna is shown in FIG. 3. As shown in the illustrative front perspective view of FIG. 3, device 10 may have a housing such as housing 12. As with housing 12 of device 10 in the examples of FIGS. 1 and 2, some or all of housing 12 and other components in device 10 of FIG. 3 may be formed from conductive materials that tend to block radio-frequency signals. For example, housing 12 may be formed from metal (e.g., stainless steel, aluminum, etc.), conductive composites, metal-filled polymers, plastic with embedded metal parts, etc. Device 10 may also include conductive components such as display 14. Display 14 may be, for example, a liquid crystal display (LCD), an organic light-emitting diode (OLED) display, an electronic ink display, or other suitable display. A capacitive touch sensor may be incorporated into display 14 to make display 14 touch sensitive if desired. User interface components such as button 36 and the touch sensitive screen of display 14 may be used to gather user input.

Figure 4:
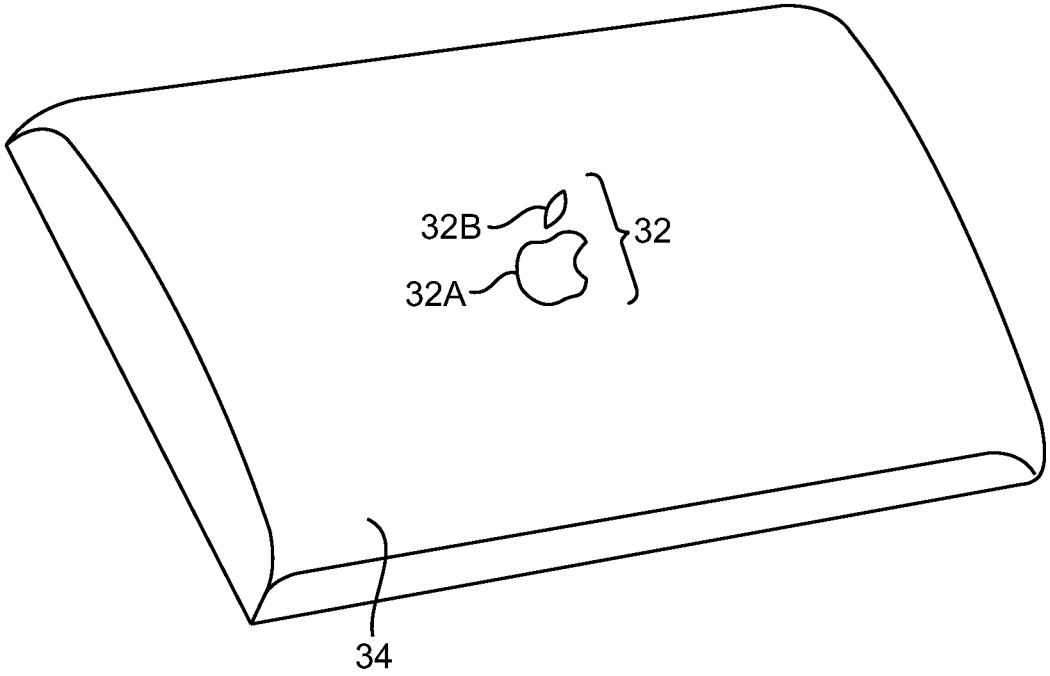
FIG. 4 is a rear perspective view of an illustrative electronic device such as a tablet-shaped portable computing device with an antenna in accordance with an embodiment of the present invention.

A rear perspective view of device 10 of FIG. 3 is shown in FIG. 4. As shown in FIG. 4, housing 12 may have a rear surface 34. Rear surface 34 may be substantially planar. For example, surface 34 may form a flat rectangular plane or, as with rear planar surface 34 of device 10 of FIG. 2, may form a substantially planar surface that is slightly curved in one or two of its lateral dimensions.

Dielectric antenna window structures such as logo-shaped antenna window structures 32 may be formed on rear housing surface 34. Structures 32 may include structures such as structure 32A and structure 32B. Structure 32A may be a dielectric structure that forms a window in conductive housing surface 34. Structure 32B may be used to help form the logo shape of structures 32 and need not be used as an antenna window (as an example).

Figure 5:
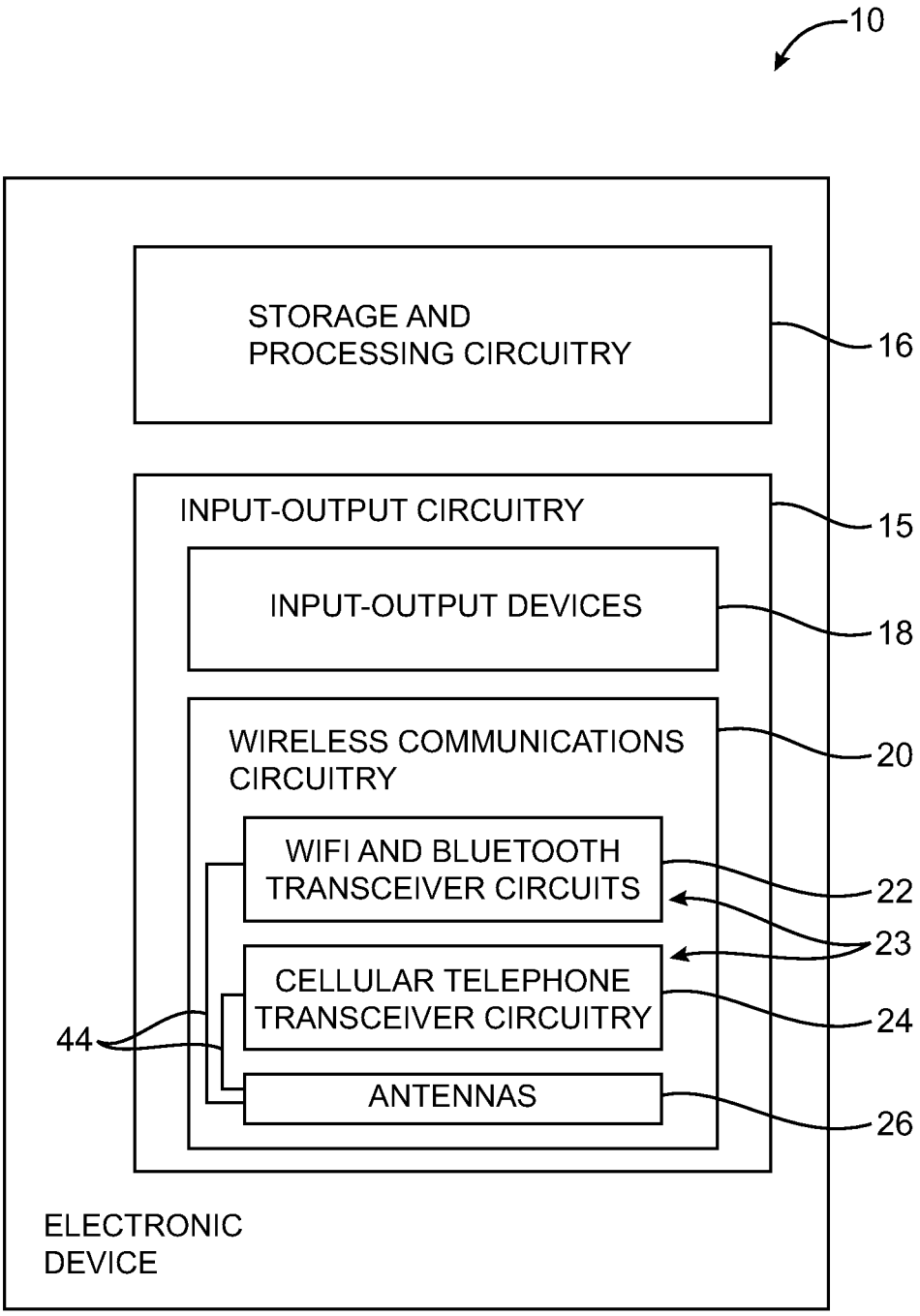
FIG. 5 is a schematic diagram of an illustrative electronic device with antenna structures in accordance with an embodiment of the present invention.

As shown in FIG. 5, electronic devices such as devices 10 of FIGS. 1-4 may include storage and processing circuitry 16. Storage and processing circuitry 16 may include one or more different types of storage such as hard disk drive storage, nonvolatile memory (e.g., flash memory or other electrically-programmable-read-only memory), volatile memory (e.g., static or dynamic random-access-memory), etc. Processing circuitry in storage and processing circuitry 16 may be used to control the operation of device 10. Processing circuitry 16 may be based on a processor such as a microprocessor and other suitable integrated circuits. With one suitable arrangement, storage and processing circuitry 16 may be used to run software on device 10, such as internet browsing applications, voice-over-internet-protocol (VOIP) telephone call applications, email applications, media playback applications, operating system functions, etc. Storage and processing circuitry 16 may be used in implementing suitable communications protocols. Communications protocols that may be implemented using storage and processing circuitry 16 include internet protocols, wireless local area network protocols (e.g., IEEE 802.11 protocols—sometimes referred to as WiFi®), protocols for other short-range wireless communications links such as the Bluetooth® protocol, etc.

Input-output circuitry 15 may be used to allow data to be supplied to device 10 and to allow data to be provided from device 10 to external devices. Input-output devices 18 such as touch screens and other user input interface are examples of input-output circuitry 15. Input-output devices 18 may also include user input-output devices such as buttons, joysticks, click wheels, scrolling wheels, touch pads, key pads, keyboards, microphones, cameras, etc. A user can control the operation of device 10 by supplying commands through such user input devices. Display and audio devices may be included in devices 18 such as liquid-crystal display (LCD) screens, light-emitting diodes (LEDs), organic light-emitting diodes (OLEDs), and other components that present visual information and status data. Display and audio components in input-output devices 18 may also include audio equipment such as speakers and other devices for creating sound. If desired, input-output devices 18 may contain audio-video interface equipment such as jacks and other connectors for external headphones and monitors.

Wireless communications circuitry 20 may include radio-frequency (RF) transceiver circuitry 23 formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Wireless communications circuitry 20 may include radio-frequency transceiver circuits for handling multiple radio-frequency communications bands. For example, circuitry 20 may include transceiver circuitry 22 that handles 2.4 GHz and 5 GHz bands for WiFi (IEEE 802.11) communications and the 2.4 GHz Bluetooth communications band. Circuitry 20 may also include cellular telephone transceiver circuitry 24 for handling wireless communications in cellular telephone bands such as the GSM bands at 850 MHz, 900 MHz, 1800 MHz, and 1900 MHz, and the 2100 MHz data band (as examples). Wireless communications circuitry 20 can include circuitry for other short-range and long-range wireless links if desired. For example, wireless communications circuitry 20 may include global positioning system (GPS) receiver equipment, wireless circuitry for receiving radio and television signals, paging circuits, etc. In WiFi and Bluetooth links and other short-range wireless links, wireless signals are typically used to convey data over tens or hundreds of feet. In cellular telephone links and other long-range links, wireless signals are typically used to convey data over thousands of feet or miles.

Wireless communications circuitry 20 may include antennas 26. Some or all of antennas 26 may be formed under dielectric antenna windows such as logo-shaped dielectric antenna windows (i.e., some or all of antennas 26 may be logo antennas). Antenna arrangements in which the dielectric antenna window for the antenna is formed in the shape of a logo (or part of a logo) are therefore sometimes described herein as an example. This is, however, merely illustrative. Antennas 26 may have any suitable antenna window shape if desired.

Antennas 26 may be single band antennas that each cover a particular desired communications band or may be multiband antennas. A multiband antenna may be used, for example, to cover multiple cellular telephone communications bands. If desired, a dual band logo antenna may be used to cover two WiFi bands (e.g., 2.4 GHz and 5 GHz). Different types of antennas may be used for different bands and combinations of bands. For example, it may be desirable to form a dual band antenna for forming a local wireless link antenna, a multiband antenna for handling cellular telephone communications bands, and a single band antenna for forming a global positioning system antenna (as examples).

Paths 44 such as transmission line paths may be used to convey radio-frequency signals between transceivers 22 and 24 and antennas 26. Radio-frequency transceivers such as radio-frequency transceivers 22 and 24 may be implemented using one or more integrated circuits and associated components (e.g., switching circuits, matching network components such as discrete inductors, capacitors, and resistors, and integrated circuit filter networks, etc.). These devices may be mounted on any suitable mounting structures. With one suitable arrangement, transceiver integrated circuits may be mounted on a printed circuit board. Paths 44 may be used to interconnect the transceiver integrated circuits and other components on the printed circuit board with logo antenna structures in device 10. Paths 44 may include any suitable conductive pathways over which radio-frequency signals may be conveyed including transmission line path structures such as coaxial cables, microstrip transmission lines, etc.

Logo antennas 26 may, in general, be formed using any suitable antenna types. Examples of suitable antenna types for logo antennas 26 include antennas with resonating elements that are formed from patch antenna structures, inverted-F antenna structures, structures that exhibit both patch-like and inverted-F-like structures, closed and open slot antenna structures, loop antenna structures, monopoles, dipoles, planar inverted-F antenna structures, hybrids of these designs, etc. All or part of a logo antenna may be formed from a conductive portion of housing 12. For example, housing 12 or a part of housing 12 may serve as a conductive ground plane for a logo antenna.

Conductive cavities may also be provided for antennas 26. Portions of housing 12 and/or separate conductive cavity structures may, for example, form an antenna cavity for an antenna with a logo-shaped dielectric window (e.g., to form a cavity-backed logo antenna design).

Figure 6:
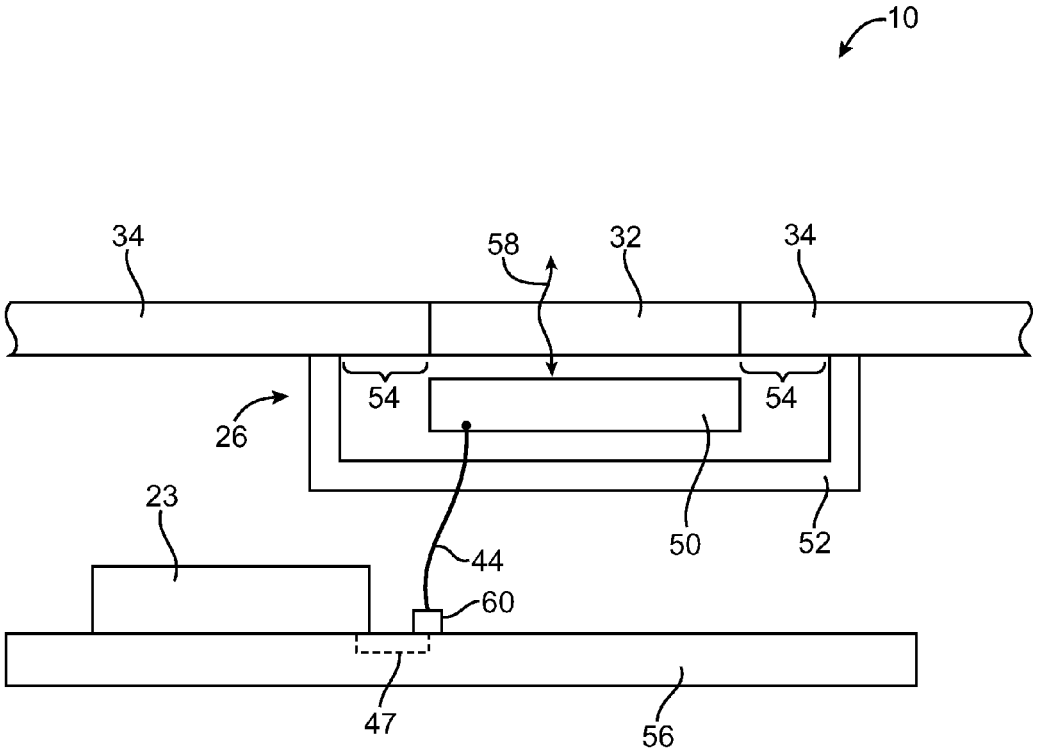
FIG. 6 is a cross-sectional side view of an electronic device with antenna structures that include an antenna cavity mounted against conductive housing walls in accordance with an embodiment of the present invention.

A cross-sectional side view of an illustrative cavity-backed antenna 26 of the type that may be used in device 10 is shown in FIG. 6. As shown in FIG. 6, antenna window 32 may be formed in conductive housing wall 34. Antenna 26 may be mounted in the interior of device 10. As illustrated by radio-frequency signal 58, the presence of antenna window 32 allows radio-frequency antenna signals to pass between antenna 26 and the exterior of device 10.

Antenna 26 may be formed from antenna structures 50 and 52. Structure 52 may also form part of a cavity for antenna 26. Some of housing walls 34 (e.g., overhanging housing wall portions 54) may also form part of the cavity. Antenna structures 50 may include an antenna resonating element such as a patch-type antenna resonating element.

Structures 50 and the antenna cavity (e.g., the cavity formed from cavity wall structure 52 and cavity wall portions 54) may be coupled to a coaxial cable or other transmission line 44. For example, a coaxial cable ground conductor may be coupled to cavity structure 52 and may be coupled to an antenna feed terminal (e.g., a ground feed) within antenna structure 50. A coaxial cable signal conductor may be coupled to another antenna feed terminal (e.g., a positive feed) that is associated with the resonating element in antenna structure 50.

Transmission line 44 may be coupled to transceiver circuitry 23 on printed circuit board 56 using connector 60 and transmission line traces 47. Circuitry 23 may also be coupled to other antennas (e.g., antennas that are used to implement an antenna diversity scheme).

Antennas such as antenna 26 of FIG. 6 may operate at any suitable frequencies. As an example, antenna 26 may be a dual band antenna that operates in first band such as a 2.4 GHz WiFi® band and that operates in a second band such as a 5 GHz WiFi® band.

Figure 7:
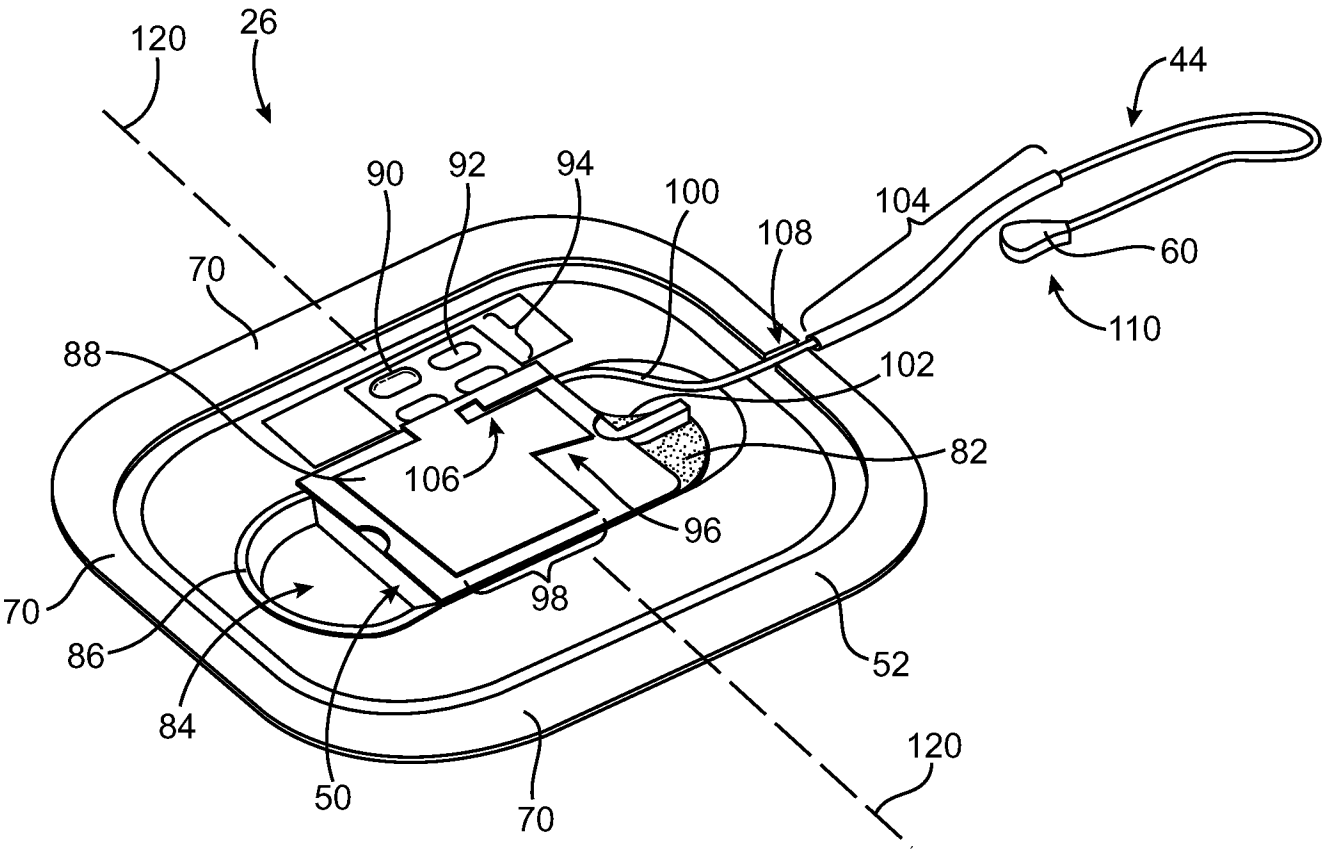
FIG. 7 is a front perspective view of an antenna resonating element and associated conductive antenna cavity structure that may be used in forming an antenna for an electronic device in accordance with an embodiment of the present invention.

A front perspective view of an illustrative antenna of the type that may be used in devices such as device 10 of FIGS. 1 and 2 and device 10 of FIGS. 3 and 4 is shown in FIG. 7. As shown in FIG. 7, antenna 26 may have an associated antenna cavity structure such as cavity structure 52. Cavity structure 52 may be formed from a conductive material such as metal. For example, cavity structure 52 may be formed from stainless steel, aluminum, or other metals. If desired, cavity structure 52 may be plated. For example, cavity structure 52 may be plated with a thin metal coating of a solderable metal such as nickel or tin. By forming cavity structure 52 from two metals, cavity structure 52 can be formed from a material that is not too costly and that is not overly difficult to shape during manufacturing operations (e.g., stainless steel or aluminum) without compromising its ability to form solder connections. Solder will adhere well to the outer (plated) metal layer thereby facilitating the formation of solder connections. Solder connections may be used to attach conductive elements such as transmission line elements and the antenna resonating element of antenna 26 to cavity structure 52.

Any suitable shape may be used for cavity structure 52. In the example of FIG. 7, cavity structure 52 has a rectangular outline with rounded corners. Other shapes may also be used (e.g., shapes with only straight outline segments, shapes with only curved outline segments such as circles and ovals, shapes with both straight and curved portions, etc.).

The cavity formed by cavity structure 52 may be characterized by a depth (i.e., the distance below the surface of housing wall 34). The cavity may have a single depth or may have multiple depths. In the FIG. 7 example, cavity structure 52 has a planar lip (lip 70) that extends around the periphery of cavity structure 52. Conductive adhesive may be used to attach planar lip 70 to the underside of housing wall 34, thereby attaching cavity structure 52 to housing 12. The innermost portion of cavity structure 52 may lie farther below housing wall 34 than the portions of cavity structure 52 that lie adjacent to lip 70 (i.e., there may be two distinct depths associated with the cavity formed by cavity structure 52). Other configurations may be used if desired (e.g., to form cavities having three or more distinct depths, to form cavities with curved walls, etc.). The two-depth arrangement of FIG. 7 is merely illustrative.

Because of the two-tiered shape of the rear cavity wall in cavity structure 52 of FIG. 7, the antenna cavity has deeper portions and shallower portions. Cavities shapes such as these, which have rear walls at different depths, may be used to maximize the volume of the antenna cavity and the separation between conductive cavity walls and the antenna resonating element structures of antenna structures 50 while simultaneously accommodating desired components within housing 12.

Antenna structures 50 may include antenna resonating element 88 and antenna support structure 82. Antenna support structure 82 may be formed from glass, ceramic, plastic, or any other suitable dielectric material. For example, antenna support structure 82 may be formed from a dielectric such as plastic. The plastic may be, for example, a thermoplastic (e.g., a material such as acrylonitrile butadiene styrene (ABS), polycarbonate (PC), or an ABS/PC blend). The plastic may be formed into a desired shape for support structure 82 using injection molding. To reduce dielectric loading on antenna 26, structure 82 may have a depressed portion 84 (i.e., a portion that is lower in height than surrounding wall portion 86). Portion 84 may be a planar region that is shallower in height than the lip 86. By removing material from structure 82 within the interior portion of structure 82 so that interior portion 84 has less height than peripheral wall 86, the amount of dielectric material in the vicinity of antenna 26 and therefore the amount of dielectric loading on antenna 26 can be minimized.

Antenna resonating element 88 may be formed from conductive materials such as copper, gold, copper that has been plated with gold, other metals, etc. These conductive materials may be formed using stamped or otherwise patterned metal foil, metal traces formed directly on a plastic support structure such as antenna support structure 82, or traces formed on a printed circuit board (as examples). Printed circuit boards can be formed from rigid substrates such as fiberglass-filled epoxy or may be formed from flexible substrates such as flexible polymers (e.g., polyimide). In the example of FIG. 7, antenna resonating element 88 has been formed from patterned metal traces on a flexible printed circuit (sometimes referred to as a "flex circuit").

Antenna resonating element 88 may be configured to operate in any suitable communications bands. In the example of FIG. 7, antenna 26 is a dual band antenna (e.g., a WiFi® antenna that resonates at 2.4 GHz and 5 GHz). Other bands may be supported if desired.

Antenna resonating element 88 may be fed at antenna feed 106. Antenna feed 106 may include a ground antenna feed terminal and a positive antenna feed terminal. Coaxial cable 44 may be routed to the underside of the flex circuit in which antenna resonating element 88 is formed. The coaxial cable may have signal and ground conductors coupled to the positive and ground antenna feed terminals. Vias may be used to form electrical connections for the antenna feed terminals in antenna feed 106.

Antenna resonating element 88 may include first portion 98 and second portion 96. Portions 98 and 96 may have the shape of rectangles (as an example) and may serve as branches (also sometimes referred to as arms or stubs) for antenna resonating element 88. The overall frequency response of antenna resonating element 88 includes a first gain peak centered at 2.4 GHz for the low band of antenna 26 and a second gain peak centered at 5 GHz for the high band of antenna 26. The size and shape of resonating element portion 96 (i.e., the smaller of the two stubs for resonating element 88) may have relatively more impact on the bandwidth and resonant frequency for the high band, whereas the size and shape of resonating element portion 98 may have relatively more impact on the bandwidth and resonant frequency for the low band. The size and shape of the cavity formed by cavity structure 52 also tends to influence the frequency response of antenna 26.

Lip 70 of cavity structure 52 may be provided with an opening such a recess 108. Recess 108 dips below the plane of lip 70 and forms a channel that provides a passageway for coaxial cable 44. This allows coaxial cable 44 to pass from the exterior of the antenna cavity to the interior of the antenna cavity when lip 70 is attached to the underside of housing wall 34. With the recess arrangement of FIG. 7, coaxial cable 44 can be passed from the exterior of the cavity to the interior of the cavity without the need to thread the cable through a small opening. Rather, cable 44 can be placed into the groove formed by the recess. When cavity structure 52 is mounted to housing 12, the recessed portion of cavity structure 52 will force cable 44 upwards against the innermost surface of the housing, thereby holding cable 44 in place.

End 110 of cable 44 may be provided with connector 60, so that cable 44 can be attached to a printed circuit board such as board 56 of FIG. 6. Cable 44 may have an inner signal conductor and an outer ground conductor that are connected to the terminals of connector 60. Along the length of cable 44, the inner signal conductor and the outer ground conductor may be separated by a dielectric. The outer ground conductor may, for example, be formed from a braid of thin wires. To prevent inadvertent shorts, the ground conductor may be coated with an insulating coating such as plastic sheath. In the FIG. 7 example, sheath 104 covers the middle portion of cable 44. The remaining portions of cable 44 are uncovered (i.e., the ground conductor is exposed). To reduce noise, the cable 44 and its exposed ground conductor may be soldered or otherwise connected to ground. For example, the portion of cable 44 that lies outside of the antenna cavity may be connected to grounded housing structures using clips or solder connections.

In the interior portion of cavity structure 52, the exposed ground conductor of cable 44 may be shorted to cavity structure 52 using solder joints. For example, solder 100 may be used to electrically and mechanically connect cable 44 to cavity structure 52. To provide sufficient room for forming solder 100 without interference from the dielectric of dielectric support 86, dielectric support 86 may be provided with a recessed portion such as recessed portion 102. Recessed portion 102 of dielectric antenna support structure 86 may have any suitable shape that provides additional clearance for forming solder joints. In the example of FIG. 7, recess 102 has the shape of a semicircular cut-away portion. Other recess shapes may be used if desired.

The shape of support structure 82 allows support structure 82 to fit snuggly within the lowermost cavity portion of cavity structure 52. This helps align support structure 82 within cavity structure 52 and thereby aligns antenna resonating element 88.

Antenna resonating element 88 may have a ground portion 94 that is connected to the rear wall of cavity structure 52 (i.e., the shallower portion of the rear wall). Holes 92 may be provided in antenna resonating element 88 to facilitate the formation of solder connections. Each of holes 92 is preferably filled with a solder joint that connects ground portion 94 of antenna resonating element 88 to cavity structure 52. In FIG. 7, only a single solder joint (solder 90) is shown to avoid obscuring holes 92 and to avoid over-complicating the drawing. In practice, each of holes 92 may be filled with a respective solder ball to minimize the resistance of the electrical path between ground portion 94 of resonating element 88 and the ground formed by cavity structure 52.

Figure 8:
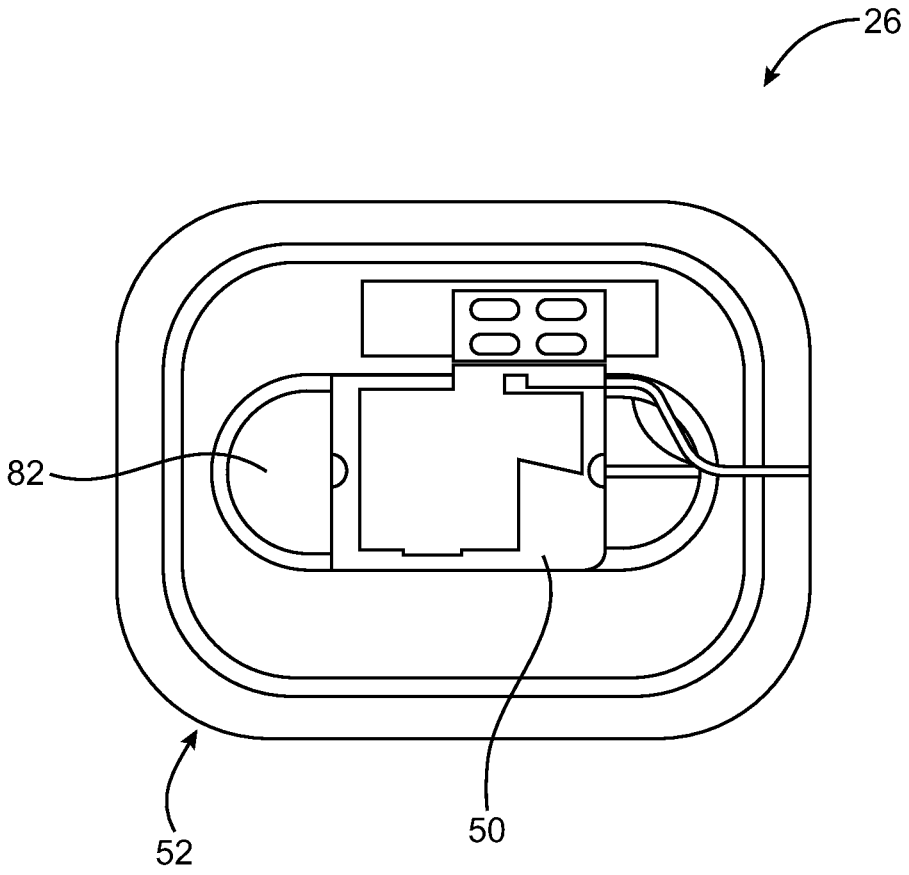
FIG. 8 is a top view of an antenna resonating element and associated conductive antenna cavity structure of the type shown in FIG. 7 that may be used in forming an antenna for an electronic device in accordance with an embodiment of the present invention.
Figure 9:
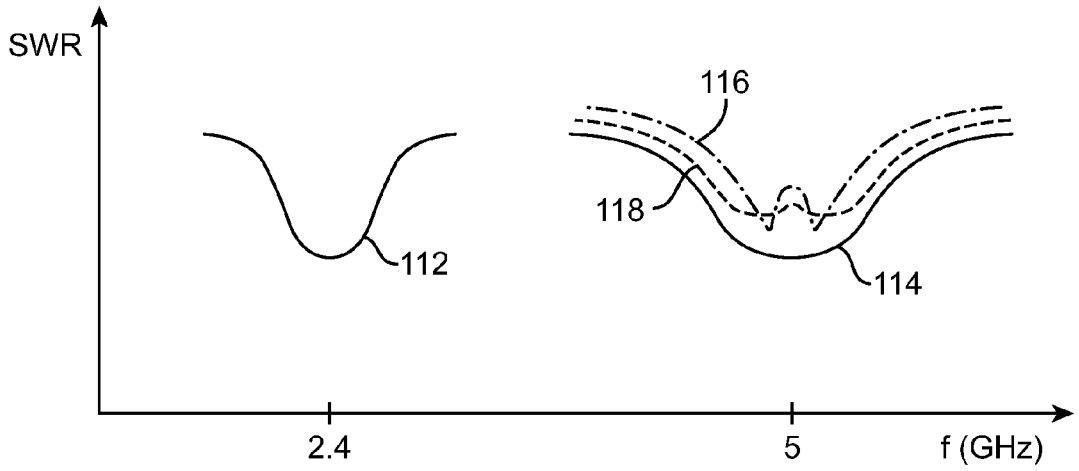
FIG. 9 is a graph showing an illustrative frequency response for a dual band antenna of the type shown in FIGS. 7 and 8 in accordance with an embodiment of the present invention.

A top view of antenna 26 is shown in FIG. 8. Due to the shape of antenna resonating element 88 and because of the presence of antenna cavity 52, antenna 26 may exhibit a dual band response. A graph showing an illustrative response of an antenna of the type shown in FIGS. 7 and 8 is shown in FIG. 9. In the graph of FIG. 9, antenna response (standing wave ratio) is plotted as a function of operating frequency. As shown in FIG. 9, antenna 26 may have a first response peak such as peak 112 and a second response peak such as peak 114. Peak 112 allows antenna 26 to operate in a first communications band, whereas peak 114 allows antenna 26 to operate in a second communications band. The first communications band may be, for example, a 2.4 GHz WiFi® band and the second communications band may be, for example, a 5 GHz WiFi® band.

The cavity formed by cavity structure 52 may be too small to contribute significantly to the efficiency of antenna 26 in low-band resonant peak 112 and may even reduce efficiency somewhat in the low band. However, high-band resonant peak 114 may include contributions from resonating element 88 (see, e.g., dashed-and-dotted curve 116) and from cavity modes due to cavity resonances in the cavity formed by cavity structure 52 (see, e.g., dashed curve 118). In operation, the responses from curves 116 and 118 combine to form the overall high-band frequency response of curve 114.

Figure 10:
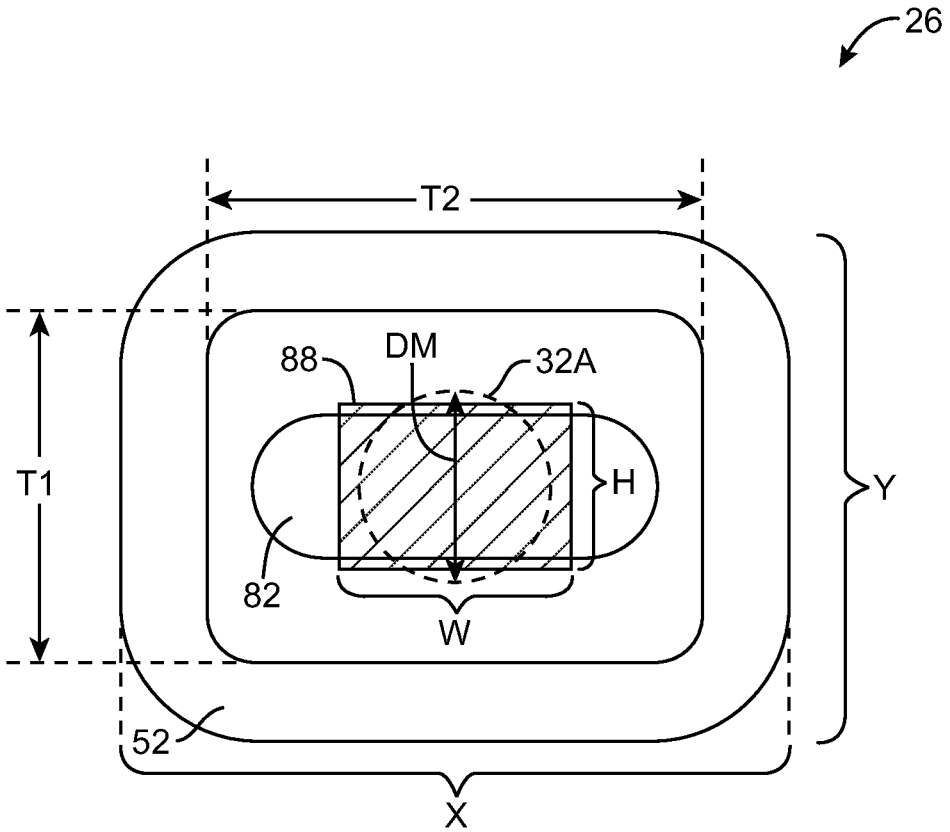
FIG. 10 is a top view of an antenna of the type shown in FIGS. 7 and 8 showing how the antenna may be positioned under a dielectric antenna window in accordance with an embodiment of the present invention.

It is not necessary for the size of dielectric antenna window 32A to overlap all of antenna cavity structure 52. For example, antenna window 32A may have lateral dimensions that are sufficient to completely or fully cover the area of antenna resonating element 88 without completely covering the footprint of antenna cavity structure 52. A typical arrangement is shown in FIG. 10. As shown in FIG. 10, dielectric antenna window 32A may form an aperture with a diameter DM. Diameter DM may be smaller than the dimensions of the outline of antenna cavity structure 52 (i.e., less than both outer cavity structure dimensions X and Y) and may be smaller than the inner dimensions of the antenna cavity (i.e., less than both cavity dimensions T1 and T2). At the same time, the size of antenna window 32A may be comparable to the size of antenna resonating element 88 (i.e., antenna window aperture DM may be comparable to dimensions H and W for antenna resonating element 88). In the example of FIG. 10, dimension DM of antenna window 32A is somewhat larger than lateral dimension H and is somewhat smaller than lateral dimension W. This is, however, merely illustrative. The size of antenna window 32A may be such that the antenna window is smaller than the antenna resonating element or may be such that the antenna window is larger than the antenna resonating element. In general, the area of antenna window 32A (and therefore the size of the opening in conductive housing wall 34) may be substantially similar to the area of the antenna resonating element.

Figure 11:
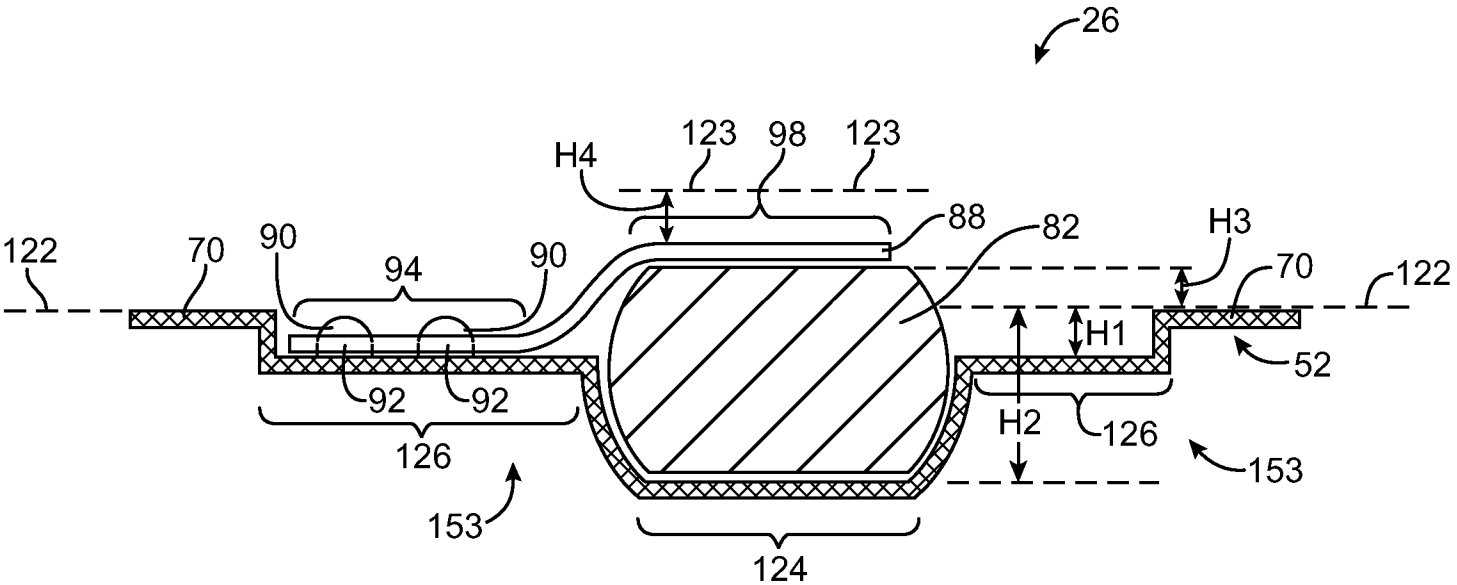
FIG. 11 is a cross-sectional side view of an antenna of the type shown in FIGS. 7 and 8 showing how an antenna resonating element may be formed from a flexible printed circuit having portions that are connected to a conductive antenna cavity structure and having portions that are mounted on a dielectric antenna support structure in accordance with an embodiment of the present invention.

A cross-sectional side view of antenna 26 of FIG. 7 taken along line 120-120 is shown in FIG. 11. As shown in FIG. 11, cavity structure 52 may have a planar lip 70 that is aligned with plane 122. When assembled in device 10, plane 122 may lie flush with the inner surface of housing wall 34. Cavity structure 52 may have a rear wall of varying depths. Rear wall portion 124 may lie at a depth of H2 below plane 122. Ring-shaped rear wall portion 126 may lie at a depth H1 below plane 122.

Ground portion 94 of the flex circuit that contains antenna resonating element 88 may be connected to portion 126 of cavity structure 52 using solder balls 90 formed in holes 92. Portion 98 of antenna resonating element 88 may be supported on support structure 82. As shown in FIG. 11, antenna resonating element 88 may be supported at a vertical position that is above plane 122 (e.g., at a height H3 above the planar surface of lip 70). Plane 123 may be associated with the exterior surface of housing wall 34 and dielectric window 32 (i.e., the exterior surface of housing wall 34 in the vicinity of window 32 and the exterior surface of dielectric window 32 lie substantially within plane 123). When antenna resonating element 88 is mounted as shown in FIG. 11, antenna resonating element 88 may lie between plane 122 and plane 123 (i.e., above plane 122 and below plane 123). This may help to elevate the antenna resonating element away from conductive cavity walls and towards the exterior of device 10, thereby enhancing antenna efficiency.

Figure 12:
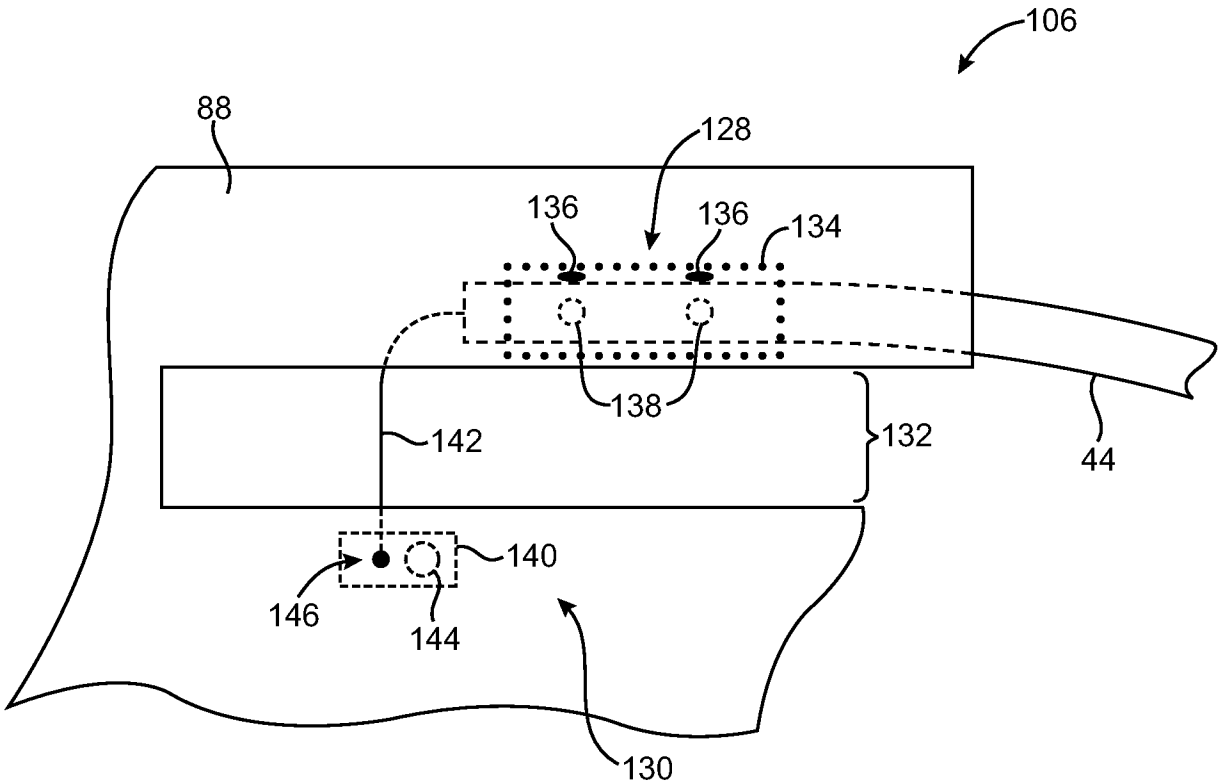
FIG. 12 is a top view of a portion of an antenna of the type shown in FIGS. 7 and 8 showing how a transmission line such as a coaxial cable transmission line may be coupled to positive and ground antenna feed terminals associated with the antenna in accordance with an embodiment of the present invention.

A detailed top view of antenna 26 in the vicinity of antenna feed 106 (FIG. 7) is shown in FIG. 12. As shown in FIG. 12, antenna resonating element 88 may have portions 128 and 130 that are separated by gap 132. Portions 128 and 130 may be formed in one of the layers of a flex circuit (e.g., an upper layer). A backside layer or other layer in the flex circuit may be used to form rear contact pads such as contact pads 134 and 140. Pad 134 may be shorted to portion 128 of resonating element 88 using vias 138. Pad 140 may be shorted to portion 130 of resonating element 88 using via 144. The ground conductor of coaxial cable 44 (e.g., the outer braid conductor) may be soldered to contact pad 134 using solder 136. The signal conductor of coaxial cable 44 (e.g., center conductor 142) may be soldered to pad 140 using solder 146. With this type of structure, pad 134 may serve as the ground antenna feed terminal for antenna feed 106 and pad 140 may serve as the positive antenna feed terminal for antenna feed 106.

Figure 13:
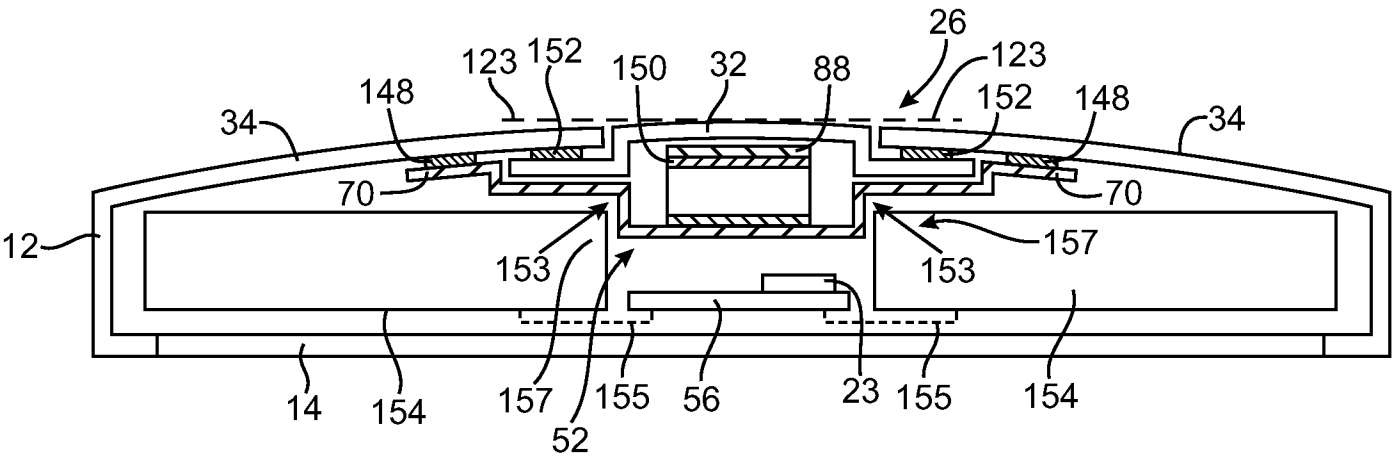
FIG. 13 is a cross-sectional side view illustrating how different depths may be associated with different parts of a conductive antenna cavity structure for an antenna in accordance with an embodiment of the present invention.

A cross-sectional view of an electronic device such as device 10 of FIGS. 3 and 4 that may be provided with a logo antenna is shown in FIG. 13. As shown in FIG. 13, antenna 26 may be provided with logo-shaped dielectric window 32 in conductive device housing wall 34 of housing 12. Window 32 may be provided in a rear wall of housing 12 (the upper wall of FIG. 13) and display 14 may be mounted within a front wall of housing 12 (the lower wall in the orientation of FIG. 13).

Components such as integrated circuits (e.g., transceiver 23) may be mounted on printed circuit board 56. Batteries 154 may be used to provide power for circuitry in device 10 using paths such as paths 155. The shape of cavity structure 52 (e.g., the use of rear walls at two or more distinct depths below lip 70) may be used to accommodate a variety of parts within housing 12. For example, thin parts such as board 56 may be mounted in housing 12 adjacent to the deeper (thicker) portion of the antenna cavity and thicker parts such as batteries 154 may be mounted in housing 12 under the shallower (thinner) portions of the antenna cavity. The shallower depth of the shallow portion of the rear cavity walls in cavity structure 52 creates a recessed portion 153 in cavity structure 52 that accommodates corners 157 of batteries 154 or other components in device 10.

As described in connection with FIG. 11, support structure 82 may have a thickness that is sufficient to maintain the main portions of antenna resonating element 88 (e.g., portion 98 and portion 96 of FIG. 7) in a plane that lies above the surface of lip 70.

Adhesive, welds, screws, or other suitable fasteners may be used in mounting antenna 26 in device 10. For example, conductive adhesive 148 may be used to attach planar lip 70 of cavity structure 52 to the inner surface of conductive housing wall 34. Adhesive 152 may also be used to attach window 32 to housing wall 34. The flex circuit that is used in forming antenna resonating element 88 may be mounted to the upper surface of antenna support structure using adhesive 150.

Figure 14:
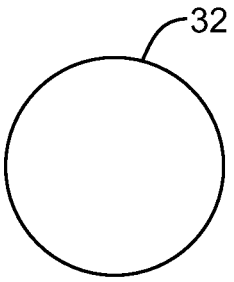
FIG. 14 is a top view of a circular logo-shaped dielectric antenna window for an electronic device cavity antenna in accordance with an embodiment of the present invention.

A logo antenna may be formed behind a dielectric window of any suitable configuration. As an example, a logo antenna may be formed from a circular dielectric window structure such as dielectric window 32 of FIG. 14.

Figure 15:
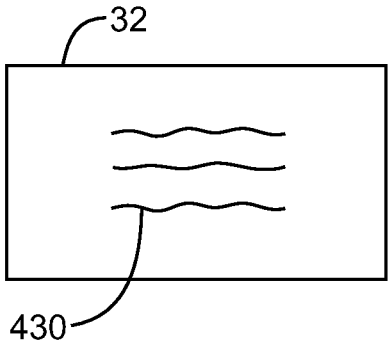
FIG. 15 is a top view of a rectangular logo-shaped dielectric antenna window for an electronic device cavity antenna in accordance with an embodiment of the present invention.

As shown by rectangular dielectric window structure 32 of FIG. 15, dielectric window structures for logo antenna 26 may be rectangular or may have other non-circular shapes. If desired, structures such as window structure 32 of FIG. 14 and window structure 32 of FIG. 15 may be provided with colored regions, text, graphics, surface texture, or other features that allow window structure 32 to convey visual information to a user. This information, which is shown schematically by lines 430 in FIG. 15, may include brand name information, promotional text, product information, product type information, or other promotional information. As an example, information 430 may include a company name, a product name, a trademark, a personalized message, or other suitable visual indicator that conveys information of promotional value or other value to a user of device 10. In a typical scenario, dielectric window 32 may include information 430 such as the name of the manufacturer of device 10. Sometimes logos can convey this information without text or by using a logo shape in combination with text, graphics, colors, etc. In the example of FIGS. 2 and 4, dielectric window 32 is a logo-shaped dielectric window having the trademark shape of a well known manufacturer of electronic devices (Apple Inc. of Cupertino, Calif.). These are merely illustrative examples. Logo antenna 26 may have any suitable dielectric logo structure that serves as a dielectric antenna window.

The foregoing is merely illustrative of the principles of this invention and various modifications can be made by those skilled in the art without departing from the scope and spirit of the invention.

What is claimed is:

1. An electronic device comprising:

a conductive housing wall, wherein the conductive housing wall includes an opening;

an antenna cavity structure mounted behind the opening, wherein the antenna cavity structure has a rectangular outline with rounded corners, and the antenna cavity structure comprises:

a planar lip mounted to an inner surface of the conductive housing wall;

a first rear wall that lies at a first depth below the inner surface of the conductive housing wall; and a second rear wall that lies at a second depth below the inner surface of the conductive housing wall, wherein the second depth is greater than the first depth, the first rear wall does not extend over the second rear wall, and the second rear wall has a rectangular outline with rounded ends; and an antenna resonating element, wherein the planar lip runs along the rectangular outline of the antenna cavity structure and surrounds the first rear wall and the first rear wall surrounds the second rear wall.

2. The electronic device defined in claim 1, wherein the planar lip, the first rear wall, and the second rear wall are each formed from conductive materials, the electronic device further comprising:

a dielectric antenna window structure in the opening of the conductive housing wall;

a dielectric antenna support structure within the antenna cavity structure; and an antenna resonating element mounted on the dielectric antenna support structure and located underneath the dielectric antenna window structure.

3. The electronic device defined in claim 2 wherein the antenna resonating element comprises a conductive trace on a flex circuit.

4. The electronic device defined in claim 3 wherein a first portion of the flex circuit is mounted to the dielectric antenna support structure.

5. The electronic device defined in claim 4 wherein a second portion of the flex circuit is mounted to the first rear wall portion.

6. The electronic device defined in claim 5 wherein the second portion of the flex circuit comprises holes and wherein the antenna further comprises solder in the holes that connects the second portion of the flex circuit to the first rear wall portion of the antenna cavity structure.

7. The electronic device defined in claim 2 wherein the antenna resonating element is formed from a first conductive layer in a flex circuit, the antenna further comprising contact pads formed from a second conductive layer in the flex circuit, wherein the contact pads serve as positive and ground antenna feed terminals for the antenna.

8. The electronic device defined in claim 2 wherein the dielectric antenna support structure has a thickness greater than the second depth and the antenna resonating element is mounted on top of the dielectric antenna support structure such that the antenna resonating element is above the inner surface of the conductive housing wall.

9. The electronic device defined in claim 2 wherein the dielectric antenna support structure has a first region underneath the antenna resonating element and a second region not underneath the antenna resonating element and wherein the first region has a thickness greater than the second region.

10. The electronic device defined in claim 1 wherein the conductive housing wall has lateral dimensions and a thickness perpendicular to the lateral dimensions, wherein the first and second depths are parallel to the thickness of the conductive housing wall.

11. The electronic device defined in claim 1 wherein the planar lip, first rear wall, and second rear wall are each ring-shaped and wherein the antenna cavity structure further comprises:

a first ring of conductive material connected between the planar lip and the first rear wall; and a second ring of conductive material connected between the first and second rear walls.

12. The electronic device defined in claim 1 wherein the conductive housing wall is planar.

13. The electronic device defined in claim 1 wherein the conductive housing wall has lateral dimensions and a thickness perpendicular to the lateral dimensions and is curved in at least one of its lateral dimensions.

14. The electronic device defined in claim 1 wherein the conductive housing wall has lateral dimensions and a thickness perpendicular to the lateral dimensions and is curved in two of its lateral dimensions.

15. The electronic device defined in claim 1 wherein the planar lip concentrically surrounds the first rear wall and wherein the first rear wall concentrically surrounds the second rear wall.

16. The electronic device defined in claim 1 wherein the first rear wall is rectangular with curved corners, has a first width, and has a first length, wherein the second rear wall is rectangular with curved corners, has a second width, and has a second length, wherein the first width is greater than the second width, and wherein the first length is greater than the second length.

17. The electronic device defined in claim 1 wherein the planar lip lies in a plane and comprises at least one recess that dips below the plane of the planar lip and wherein the recess forms a channel, the electronic device further comprising:

a transmission line that passes through the channel and that is coupled to the antenna resonating element.

18. The electronic device defined in claim 1 further comprising conductive adhesive between the planar lip and the inner surface of the conductive housing wall.

19. The electronic device defined in claim 1 wherein the conductive housing wall extends over portions of the first rear wall.

20. The electronic device defined in claim 1 wherein the conductive housing wall extends over at least half of the first rear wall.

21. The electronic device defined in claim 1 wherein the antenna cavity structure is formed from conductive materials of at least a given thickness and wherein the difference between the first and second depths is greater than the given thickness.

22. An electronic device comprising:

a conductive housing wall having an opening;

an antenna cavity structure at least part of which is mounted underneath the opening, wherein the antenna cavity structure has a rectangular outline with rounded corners, a first rear wall at a first height from the conductive housing wall and a second rear wall at a second height from the conductive housing wall that is greater than the first height;

an antenna resonating element grounded to the antenna cavity structure at a location on the first rear wall; and a dielectric antenna support structure mounted within the antenna cavity, wherein the dielectric antenna support structure comprises:

first regions underneath the opening; and second regions underneath an inner surface of the conductive housing wall, wherein a vector normal to the inner surface intersects the second regions but does not intersect the first regions, wherein the first regions of the dielectric antenna support structure are thicker than the second regions of the dielectric antenna support structure, the rectangular outline of the antenna cavity structure surrounds the first rear wall, and the first rear wall surrounds the dielectric antenna support structure.

23. The electronic device defined in claim 22 further comprising:

a dielectric antenna window structure in the opening of the conductive housing wall; and an antenna resonating element mounted on the dielectric antenna support structure and located underneath the dielectric antenna window structure, wherein the first regions of the antenna support structure are underneath the dielectric antenna window structure and underneath the antenna resonating element.

24. The electronic device defined in claim 23 wherein the dielectric antenna support structure is rectangular with curved corners and has a center region and first and second end regions.

25. The electronic device defined in claim 24 wherein the center region forms the first regions underneath the dielectric antenna window structure and underneath the antenna resonating element and wherein the first and second end regions form the second regions underneath the conductive housing wall.

26. The electronic device defined in claim 25 wherein the antenna resonating element does not extend over the first and second end regions of the dielectric antenna support structure.

27. The electronic device defined in claim 22 wherein the antenna cavity structure comprises wall portions surrounding the dielectric antenna support structure and wherein the second regions are lower in height than adjacent portions of the wall portions of the antenna cavity structure.

* * * * *